US009286885B2

(12) United States Patent
Sienel et al.

(10) Patent No.: US 9,286,885 B2
(45) Date of Patent: Mar. 15, 2016

(54) METHOD OF GENERATING SPEECH FROM TEXT IN A CLIENT/SERVER ARCHITECTURE

(75) Inventors: Jürgen Sienel, Leonberg (DE); Dieter Kopp, Illingen (DE)

(73) Assignee: Alcatel Lucent, Boulogne-Billancourt (FR)

( * ) Notice: Subject to any disclaimer, the term of this patent is extended or adjusted under 35 U.S.C. 154(b) by 1573 days.

(21) Appl. No.: 10/817,814

(22) Filed: Apr. 6, 2004

(65) Prior Publication Data

US 2004/0215462 A1 Oct. 28, 2004

(30) Foreign Application Priority Data

Apr. 25, 2003 (EP) ..... 03360052

(51) Int. Cl.
*G10L 13/00* (2006.01)
*G10L 13/047* (2013.01)
*G10L 13/06* (2013.01)

(52) U.S. Cl.
CPC ..... *G10L 13/047* (2013.01)

(58) Field of Classification Search
CPC ..... G10L 13/00; G10L 13/02; G10L 13/043; G10L 13/06; G10L 13/07; G10L 13/08
USPC ..... 704/258, 260, 270.1; 379/88.16, 88.17, 379/88.18
See application file for complete search history.

(56) References Cited

U.S. PATENT DOCUMENTS 5,802,100 A 9/1998 Pine
5,864,812 A * 1/1999 Kamai et al. ..... 704/268
5,978,765 A * 11/1999 Nagata ..... 704/258
6,188,754 B1 * 2/2001 Kikuchi et al. ..... 379/114.01
6,275,793 B1 8/2001 Tavernese
6,366,883 B1 * 4/2002 Campbell et al. ..... 704/260
6,496,801 B1 * 12/2002 Veprek et al. ..... 704/260
6,510,413 B1 * 1/2003 Walker ..... 704/258
6,516,207 B1 2/2003 Boucher et al.
6,600,814 B1 * 7/2003 Carter et al. ..... 379/88.16
6,625,576 B2 * 9/2003 Kochanski et al. ..... 704/260
6,718,339 B2 * 4/2004 Eden ..... 707/102
6,741,963 B1 * 5/2004 Badt et al. ..... 704/270
6,810,379 B1 * 10/2004 Vermeulen et al. ..... 704/260
6,963,838 B1 * 11/2005 Christfort ..... 704/260
7,013,278 B1 * 3/2006 Conkie ..... 704/260
7,043,432 B2 * 5/2006 Bakis et al. ..... 704/260
7,308,080 B1 * 12/2007 Moriuchi et al. ..... 379/88.04
7,440,899 B2 * 10/2008 Otsuka et al. ..... 704/270.1
2001/0047260 A1 * 11/2001 Walker et al. ..... 704/260
2002/0184031 A1 12/2002 Brittan
2003/0028380 A1 * 2/2003 Freeland et al. ..... 704/260
2003/0061051 A1 3/2003 Hattori et al.

* cited by examiner

*Primary Examiner* — Paras D Shah
(74) *Attorney, Agent, or Firm* — Chiesa Shahinian & Giantomasi PC

(57) ABSTRACT

In a method of generating speech from text the speech segments necessary to put together the text to be output as speech by a terminal are determined; it is checked, which speech segments are already present in the terminal and which ones need to be transmitted from a server to the terminal; the segments to be transmitted to the terminal are indexed; the speech segments and the indices of segments to be output at the terminal are transmitted; an index sequence of speech segments to be put together to form the speech to be output is transmitted; and the segments are concatenated according to the index sequence. This method allows to realize a distributed speech synthesis system requiring only a low transmission capacity, a small memory and low computational power in the terminal.

19 Claims, 1 Drawing Sheet

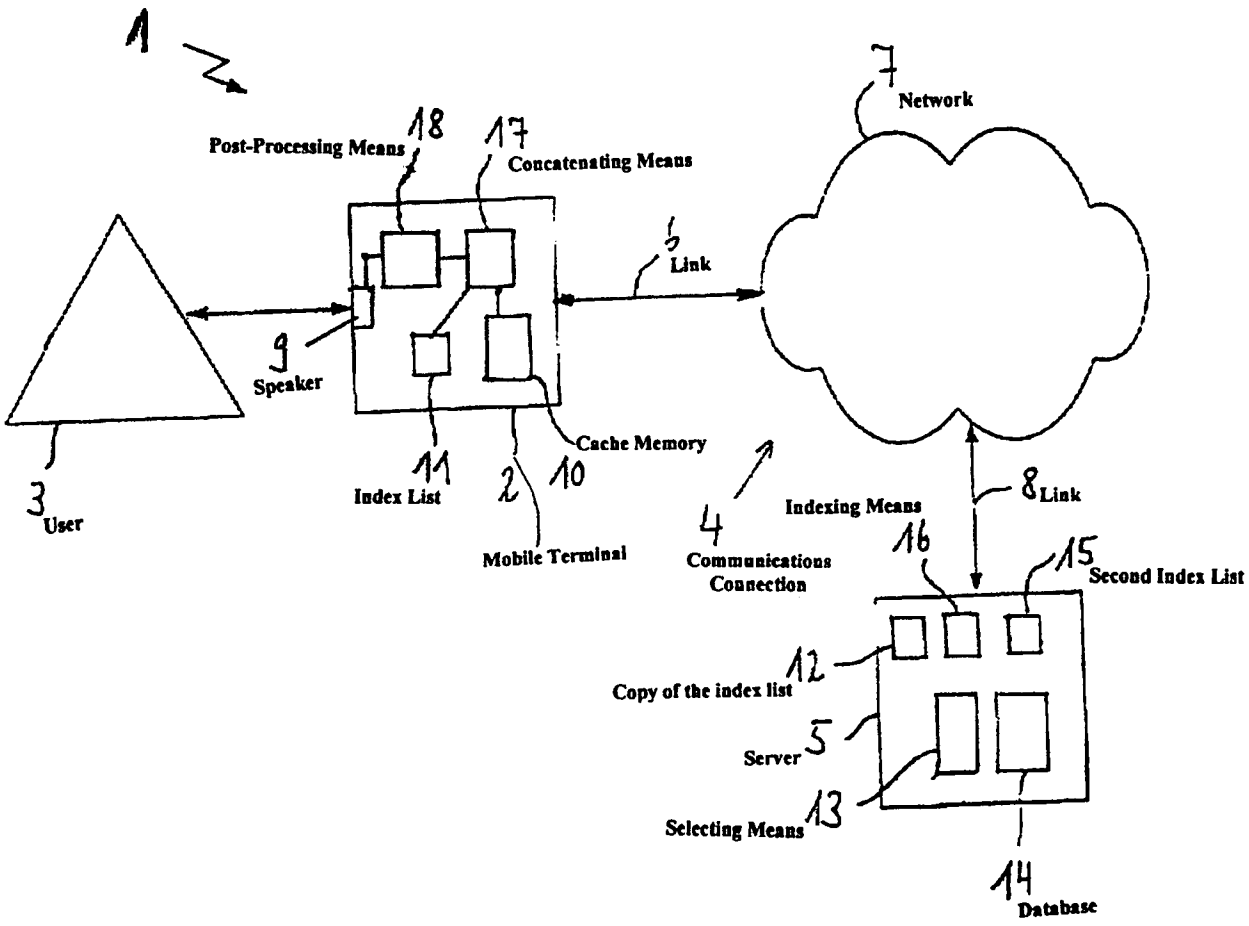
1
Post-Processing Means
18
Concatenating Means
17
Speaker
9
User
3
Link
5
Cache Memory
10
Index List
11
Mobile Terminal
2
Network
7
Link
8
Indexing Means
16
Communications Connection
4
Second Index List
15
Copy of the index list
12
Server
5
Selecting Means
13
Database
14

METHOD OF GENERATING SPEECH FROM TEXT IN A CLIENT/SERVER ARCHITECTURE

The invention is based on a priority application EP 03360052.9 which is hereby incorporated by reference.

BACKGROUND OF THE INVENTION

The invention relates to a method of generating speech from text and a distributed speech synthesis system for performing the method.

Interactive voice response systems generally comprise a speech recognition system and means for generating a prompt in form of a speech signal. For generating prompts, speech synthesis systems are often used (text-to-speech synthesis TTS). These systems transform text into a speech signal. To this end, the text is phonetized, suitable segments are chosen from a speech database (p.ex. diphones) and the speech signal is concatenated from the segments. If this is to be performed in an environment which allows data transmission, in particular, if one or more distant end terminals such as mobile phones are to be used, special requirements with respect to the end terminal and the transmission capacity exist.

Typically, a TTS is realized centrally on a server in a network, which server performs the task of translating text into acoustic signals. In telecommunications networks the acoustic signals are coded and then transmitted to the end terminal. Disadvantageously, the data volume to be transmitted using this approach is relatively high (p.ex.>4.8 kbit/s).

In another approach the TTS may be implemented in the end terminal. In this case only a text string needs to be transmitted. However, this approach requires a large memory in the end terminal in order to ensure a high quality of the speech signal. Furthermore, the TTS needs to be implemented in each terminal, requiring high computation power in each terminal.

OBJECT OF THE INVENTION

It is the object of the invention to provide a method for generating speech from text which requires only a small memory in an end terminal and which avoids having to transfer large data volumes and a system for performing the method.

DESCRIPTION OF THE INVENTION

This object is achieved by a method of generating speech from text comprising the steps of determining the speech segments necessary to put together the text to be output as speech by a terminal; checking which speech segments are already present in the terminal and which ones need to be transmitted from a server to the terminal; indexing the segments to be transmitted to the terminal; transmitting the speech segments and the indices of segments to be output at the terminal; transmitting an index sequence of speech segments to be put together to form the speech to be output; concatenating the segments according to the index sequence.

This method only requires a relatively small memory in the terminal and low computational power in each terminal. A relatively small number of speech segments is kept in a cache memory in the terminal. Speech segments used in a previous speech message are kept in the cache and may be re-used for subsequent messages. If a new text is to be output as speech by the terminal, only the speech segments which are not yet present in the terminal need to be transmitted to the terminal.

Each speech segment is associated with an index allowing access to the speech segment. Even though transmission of an index sequence is sufficient for the inventive method to work, advantageously an index list is kept in the terminal and is updated every time new speech segments are sent to the terminal. The index list may be maintained by the server. Whenever a speech segment is sent to the terminal and stored in the cache, the index list at the terminal may be updated. A copy of the updated list may be kept in the server. The server may update both index lists or it may update the index list in the terminal, which then sends a copy back to the server. If a speech segment stored in the cache is not used for a certain number of speech messages it may be deleted from the cache and replaced by another segment used more often. Hence, only a small number of speech segments is stored in the terminal as compared to a whole database of speech segments. Since only the missing segments for composing a new speech message need to be transmitted from the server, the amount of data transferred from the server to the terminal is reduced. If all the speech segments for a particular output are already present in the terminal, only the index sequence for composing the speech message needs to be transmitted. Speech segments may, p. ex., be single phonemes, groups of phonemes, words or groups of words or phrases.

In a variant of the inventive method the segments to be transmitted to the terminal are chosen from a database of speech segments. The database may comprise a large number of phonemes and/or phoneme groups. Furthermore, whole phonetized words or groups of words may be stored in the database.

Alternatively, diphones may be stored in the database. If a database is used, the contents of the database are also indexed and a second index list allowing access to the database is stored in the server. In the server new speech segments may also be generated from the data available in the database, such that segments are regrouped and new groups of p.ex. phonemes are generated, which may be sent to the terminal and provided with one single index.

Alternatively, the speech segments to be transmitted to the terminal may be generated in the server each time a text is to be output by the terminal. Either the whole text is phonetized and divided into suitable segments or only the missing parts of the text, which have not been phonetized and stored in the terminal cache previously, are phonetized. This approach does not require a database in the server containing speech segments. However, a combination is also possible. If, p.ex., a phoneme needed to output text as speech is not to be found in the database, the missing part may be generated in the server by phonetizing and transmitted to the terminal.

Preferably, the speech generated from the concatenated segments is post-processed. This operation may be performed in the terminal. Post-processing improves the quality of the speech signal.

In a particularly preferred variant of the inventive method the speech segments are associated with a time-to-live value and the index lists at the terminal and the server are maintained according to these values. The time-to-live-value may be chosen by the server according to the application course. Thus, if in a certain application a speech segment is expected to be needed in a subsequent speech message of the application or if a certain speech segment is known to be used often in a particular language, a longer time-to-live value may be associated. The time-to-live-value may be a time or a number of speech messages, dialog steps or interactions. If a particular speech segment has not been used for a given time or a given number of speech messages or dialog steps it may be deleted from the cache. The time-to-live value may be updated, i.e., a new time-to-live value may be associated with a speech segment if it is used while being stored in the cache.

A quick response and output of speech messages can be achieved if subsequent speech to be output is anticipated and necessary segments for the anticipated speech signal are transmitted to the terminal. Thus, missing segments of an anticipated subsequent speech signal can already be transmitted while the previous speech message is still being output or while a command by the user is still being processed, p.ex. by a speech recognition unit, or even while the previous message is still being processed, either in the server or the terminal. Furthermore, upon certain events standardized speech messages need to be output. For example, the request to enter a command needs to be output if a command is expected but not received after a preset time. A user may also have to be prompted to repeat a command if, p. ex., speech is not recognized by the speech recognition system. Such messages can be anticipated and the missing segments for the complete speech messages can be transmitted before the event occurs. Alternatively, such messages can be permanently stored in the cache because they occur very often.

In order to avoid outputting an incomplete speech signal or to output a speech signal at the wrong time, p.ex. while a user is still thinking about the command to enter, an enabling signal may be sent to the terminal, allowing the terminal to start with the speech output. Such a signal may be a separate signal, allowing the output after a certain pause in the interaction. Alternatively, the signal may be the end of the index sequence transmitted from the server to the terminal. The concatenation of the speech signal could already begin while the index sequence is still being transmitted. The end of the sequence may be transmitted with a delay so that upon reception of the last index of the index sequence only the speech segment corresponding to the last index needs to be attached to the speech message concatenated from the previously transmitted indices. The output can thus start immediately after the end of the index sequence is received.

Within the scope of the invention also falls a terminal suitable for outputting speech messages comprising a cache memory for storing speech segments, an index list of the indices associated with the speech segments and means for concatenating the speech segments according to an index sequence. The means for concatenating may be implemented as software and/or hardware. Such a terminal requires only a small memory and a relatively small computational power. The terminal may be a stationary or a mobile terminal. With such a terminal a distributed speech synthesis system can be realized.

A distributed speech synthesis system advantageously further comprises a server for text to speech synthesis comprising means for indexing speech segments and means for selecting missing speech segments to be transmitted to a terminal which are necessary to compose a speech message in the terminal together with speech segments already present in the terminal. The means may be implemented as software and/or hardware. Such a server allows to just transmit missing speech segments for outputting a given text as speech. The terminal is enabled to put together segments already stored in the terminal and the segments transmitted by the server to form a speech signal. The terminal and the server form a distributed speech synthesis system able to perform the inventive method. The server may communicate with several terminals, keeping a copy of the index list of the speech segments stored in the cache memory of each terminal.

Advantageously, the terminal and the server are connected by a communication connection. This may be any connection allowing the transfer of speech segments and index lists, p.ex., a data link or a speech channel. Further advantages can be extracted from the description and the enclosed drawing. The features mentioned above and below can be used in accordance with the invention either individually or collectively in any combination. The embodiments mentioned are not to be understood as exhaustive enumeration but rather have exemplary character for the description of the invention.

BRIEF DESCRIPTION OF THE DRAWINGS

An exemplary embodiment of the present invention is shown schematically in the drawing.

FIG. 1 shows a distributed speech synthesis system.

DETAILED DESCRIPTION OF EXEMPLARY EMBODIMENTS

FIG. 1 shows a distributed speech synthesis system 1. The system 1 comprises a mobile terminal 2 suitable for receiving speech from a user 3 and to output speech signals to the user 3. The terminal 2 is connected via a communications connection 4 to a server 5. The communications connection 4 comprises a first link 6 connecting the terminal 2 to a network 7 and a second link 8 between the network 7 and the server 5. The terminal 2 prompts the user 3 to input a command. For recognizing the command, the terminal 2 may comprises a speech recognition unit. However, the speech recognition may also be implemented as distributed speech recognition system with parts of the speech recognition system implemented in the terminal 2 and parts implemented in the server 5. Once the user input has been recognized, the server 5 determines, which text message is to be output by the speaker 9 of the terminal 2. In the terminal 2 a cache memory 10 is provided, which stores a limited number of speech segments. The speech segments are associated with an index. An index list 11 is also provided in the terminal 2, allowing access to the speech segments stored in the cache 10. A copy 12 of the index list 11 is kept in the server 5. Hence, the server 5 first determines which speech segments are needed in order to compose the speech message representing the text to be output by the terminal 2. Then it determines in selecting means 13, which speech segments are already stored in the cache memory 10 and which ones need to be transferred to the cache 10 in order to enable the speech message to be composed in the terminal 2. The missing segments are selected from a database 14 by means of a second index list 15 and are indexed by indexing means 16. The indexed segments are being sent to the terminal 2 via communications connection 4 together with or followed by an updated index list and an index sequence. The new segments are stored in the cache memory 10. Then the speech signal is concatenated by means 17 for concatenating the speech segments according to the transmitted index sequence. The concatenated speech signal is post-processed in a post-processing means 18 and output via the speaker 9.

In a method of generating speech from text the speech segments necessary to put together the text to be output as speech by a terminal 2 is determined; it is checked, which speech segments are already present in the terminal 2 and which ones need to be transmitted from a server 5 to the terminal 2; the segments to be transmitted to the terminal 2 are indexed; the speech segments and the indices of segments to be output at the terminal 2 are transmitted; an index sequence of speech segments to be put together to form the speech to be output is transmitted; and the segments are concatenated according to the index sequence. This method allows to realize a distributed speech synthesis system 1 requiring only a low transmission capacity, a small memory and low computational power in the terminal 2.

The invention claimed is:

1. A method of generating speech from text comprising:

determining speech segments necessary to put together text to be output as speech by a terminal;

checking which of the speech segments necessary to put together text to be output as speech are already present in the terminal and which speech segments necessary to put together text to be output as speech need to be transmitted from a server to the terminal;

indexing speech segments to be transmitted to the terminal;

transmitting speech segments that need to be transmitted to the terminal and indices of speech segments to be output at the terminal;

transmitting an index sequence of speech segments to be put together to form the speech to be output, the speech segments to be concatenated at the terminal according to the transmitted index sequence;

wherein the speech segments that need to be transmitted to the terminal, the indices of speech segments to be output at the terminal, and the index sequence of speech segments to be put together to form the speech to be output are transmitted to the terminal, the indices providing access information to the respective segments, wherein the speech segments are each associated with a time-to-live value based on how often a respective speech segment is known to be used, anticipating an event from a plurality of events based on an application condition, wherein each event is associated with a different standardized speech message to be output, and wherein missing speech segments required for a standardized speech message to be output and associated with the event are transmitted to the terminal, the missing speech segments being associated with a longer time-to-live value than speech segments not associated with the standardized speech message to be output.

2. The method according to claim 1, wherein speech segments to be transmitted to the terminal are chosen from a database of speech segments.

3. The method according to claim 1, wherein speech segments to be transmitted to the terminal are phonetized in the server.

4. The method according to claim 1, wherein speech generated from concatenated speech segments is post-processed.

5. The method according to claim 1, wherein an enabling signal is sent to the terminal, allowing the terminal to start speech output.

6. The method according to claim 1, wherein each speech segment is associated with an index.

7. The method according to claim 1, wherein an index list comprising the index sequence is provided by the terminal indicating which of the speech segments are stored in the terminal.

8. The method according to claim 7, wherein a copy of the index list is kept in the server.

9. The method according to claim 8, wherein:

the server further stores a second index list indicating the speech segments in a database, the speech segments not already present in the terminal are selected from a server database utilizing the second index list, and the indices of the segments are transmitted together with respective segments and indicate access to the respective segments.

10. The method according to claim 7, wherein the index list is updated every time new speech segments are sent to the terminal.

11. The method according to claim 8, wherein the server updates the index list at the terminal, which then sends a copy back to the server.

12. The method according to claim 5, wherein the enabling signal is an end of the index sequence transmitted from the server to the terminal.

13. The method according to claim 12, wherein the end of the index sequence is transmitted with a delay, such that upon reception of a last index of the index sequence the speech segment corresponding to the last index is attached to the speech and the output starts immediately after the end of sequence is received at the terminal.

14. The method according to claim 1, wherein the concatenation of the speech signal begins while the index sequence is being transmitted.

15. The method according to claim 1, wherein the time-to-live-value is based on one of a number of speech messages, dialog steps and interactions.

16. The method according to claim 15, wherein, if a particular speech segment is not used for the number of speech messages, the particular speech segment is deleted from a storage in the terminal.

17. A terminal comprising:

a cache memory for storing speech segments received from a server;

an index list of indices associated with the speech segments, the indices providing access information to respective speech segments; and means for concatenating the speech segments according to an index sequence received from the server, wherein speech segments in the cache memory of the terminal are each associated with a time-to-live value based on how often a respective speech segment is known to be used and speech segments necessary for anticipated subsequent speech to be output are received by the terminal, wherein the speech segments, the indices associated with the speech segments and the index sequence are received from the server, wherein missing speech segments required for an anticipated standardized speech message to be output are received from the server, the missing speech segments being associated with a longer time-to-live value than speech segments not associated with the anticipated standardized speech message to be output, the anticipated standardized speech message to be output associated with an event of a plurality of events, the event being anticipated based on an application condition, each of the plurality of events associated with a different standardized speech message to be output.

18. A server for text to speech synthesis comprising:

means for indexing speech segments; and means for selecting missing speech segments to be transmitted to a terminal which are necessary to compose a speech message in the terminal together with speech segments already present in the terminal, means for transmitting the selected speech segments and indices of speech segments to be output at the terminal;

means for transmitting an index sequence of speech segments to be put together to form the speech message, the speech segments to be concatenated at the terminal according to the transmitted index sequence;

wherein the selected speech segments, the indices of speech segments, and the index sequence are transmitted to the terminal, the indices providing access information to respective segments, wherein speech segments are each associated with a time-to-live value based on how often a respective speech segment is known to be used, means for anticipating an event from a plurality of events based on an application condition, wherein each event is associated with a different standardized speech message to be output; and wherein missing speech segments required for an anticipated standardized speech message to be output are transmitted to the terminal, the missing speech segments being associated with a longer time-to-live value than speech segments not associated with the anticipated standardized speech message.

19. A distributed speech synthesis system comprising at least one terminal comprising a cache memory for storing speech segments, an index list of the indices associated with the speech segments and means for concatenating the speech segments according to an index sequence and at least one server according to claim 18 which are connected by a communications connection.

* * * * *